US007726657B2

(12) United States Patent
Shalosky

(10) Patent No.: US 7,726,657 B2
(45) Date of Patent: Jun. 1, 2010

(54) TARGET STAND SYSTEM

(76) Inventor: Matt Shalosky, 1111 N. Lake Pleasant Rd., Hillsdale, MI (US) 49242

( * ) Notice: Subject to any disclaimer, the term of this patent is extended or adjusted under 35 U.S.C. 154(b) by 0 days.

(21) Appl. No.: 12/234,097

(22) Filed: Sep. 19, 2008

(65) Prior Publication Data

US 2009/0079136 A1 Mar. 26, 2009

Related U.S. Application Data

(60) Provisional application No. 60/994,552, filed on Sep. 20, 2007.

(51) Int. Cl.
*F41J 1/10* (2006.01)

(52) U.S. Cl. ..... 273/407; 40/607.06; 248/545

(58) Field of Classification Search ..... 273/403–410; 40/607.01, 607.02, 607.05, 607.06; 247/545
See application file for complete search history.

(56) References Cited

U.S. PATENT DOCUMENTS

| | | | | | |
|---|---|---|---|---|---|
| 363,206 | A | | 5/1887 | Burgess, Jr. | |
| 2,872,750 | A | | 2/1959 | Holcomb | |
| 2,932,516 | A | * | 4/1960 | Penner | 273/402 |
| 3,057,093 | A | | 10/1962 | Gallo | |
| 3,733,073 | A | * | 5/1973 | Gutler | 273/406 |
| 4,092,792 | A | * | 6/1978 | Vorhees | 40/606.13 |
| 4,232,467 | A | * | 11/1980 | Stewart | 40/607.11 |
| 4,412,396 | A | * | 11/1983 | Silbernagel | 40/607.11 |
| 4,658,527 | A | | 4/1987 | Pingel | |
| 4,660,310 | A | | 4/1987 | Farmer | |
| 4,790,092 | A | * | 12/1988 | Farmer | 40/607.09 |
| 4,894,937 | A | | 1/1990 | Davis | |
| 5,042,183 | A | | 8/1991 | Kennedy | |
| 5,067,683 | A | * | 11/1991 | Wager | 248/545 |
| 5,103,582 | A | | 4/1992 | Farmer | |
| 5,113,627 | A | | 5/1992 | Jarrett, Sr. | |
| 5,307,580 | A | | 5/1994 | Farmer | |
| 5,375,801 | A | * | 12/1994 | Porter | 248/156 |
| 5,566,483 | A | | 10/1996 | Ogren | |
| 5,579,599 | A | | 12/1996 | Haeseler | |
| 5,595,010 | A | | 1/1997 | Fuller et al. | |
| 5,671,924 | A | * | 9/1997 | Scott | 273/407 |
| 5,682,696 | A | | 11/1997 | Gill | |
| 5,967,523 | A | * | 10/1999 | Brownlee | 273/407 |
| 6,085,452 | A | | 7/2000 | Davis | |
| 6,170,183 | B1 | | 1/2001 | Keefe | |
| 6,435,512 | B1 | * | 8/2002 | Beckwith, Sr. | 273/407 |
| 6,491,303 | B1 | * | 12/2002 | Huston | 273/407 |

(Continued)

FOREIGN PATENT DOCUMENTS

| | | | |
|---|---|---|---|
| CH | 648653 | A5 * | 3/1985 |

(Continued)

*Primary Examiner*—Mark S Graham
(74) *Attorney, Agent, or Firm*—MacMillan, Sobanski & Todd, LLC

(57) ABSTRACT

A target stand system having at least two stand assemblies is provided. Each stand assembly comprises a post member configured at one end for insertion into a support surface and a support member connected to the post member by an attachment portion such that a gap is formed between the post member and the support member. The gap has a width sufficient to support a target. The stand assemblies are spaced apart a distance to support a target.

14 Claims, 3 Drawing Sheets

U.S. PATENT DOCUMENTS 6,547,204 B1 4/2003 Peck
6,705,796 B2 * 3/2004 Lund ..... 404/6
6,922,927 B1 8/2005 Harmon
6,997,423 B1 2/2006 Nudo, Jr.
7,044,449 B2 * 5/2006 Wink ..... 256/24
2002/0088157 A1 * 7/2002 Winterton et al. ..... 40/610

FOREIGN PATENT DOCUMENTS

GB 2079164 A * 1/1982

* cited by examiner

TARGET STAND SYSTEM

RELATED APPLICATIONS

This application claims the benefit of U.S. Provisional Application No. 60/994,552, filed Sep. 20, 2007, the disclosure of which is incorporated herein by reference.

TECHNICAL FIELD

This invention relates generally to targets used for target practice. More particularly, this invention relates to mounting a target in a target stand.

BACKGROUND OF THE INVENTION

Targets are used by sports enthusiasts for many purposes including competitive matches, pre-hunting scope sighting and general recreational purposes. Targets can be used for many implements, including for example firearms, archery equipment, crossbows and slingshots.

Targets are often printed on heavy paper stock or cardboard. Alternatively, targets can be made of other materials, including for example plastic and foam board.

The targets are typically mounted in, and supported by, a target stand. A target stand can be a permanent structure or a portable structure. It would be advantageous to provide an improved target stand.

SUMMARY OF THE INVENTION

According to this invention there is provided a target stand system having at least two stand assemblies. Each stand assembly comprises a post member configured at one end for insertion into a support surface and a support member connected to the post member by an attachment portion such that a gap is formed between the post member and the support member. The gap has a width sufficient to support a target. The stand assemblies are spaced apart a distance to support a target.

According to this invention there is also provided a target stand system having at least two stand assemblies. Each stand assembly comprises a post member configured at one end for insertion-into a support surface. A support member is connected to the post member by an attachment portion such that a first gap is formed between the post member and the support member. The first gap has a width sufficient to support an upper target. A target support assembly is connected to the post member by an attachment portion such that a second gap is formed between the post member and the support member. The second gap has a width sufficient to support a lower target. The stand assemblies are spaced apart a distance to support the upper and lower targets.

Various advantages of this invention will become apparent to those skilled in the art from the following detailed description of the invention, when read in light of the accompanying drawings.

DETAILED DESCRIPTION OF THE INVENTION

Figure 1:
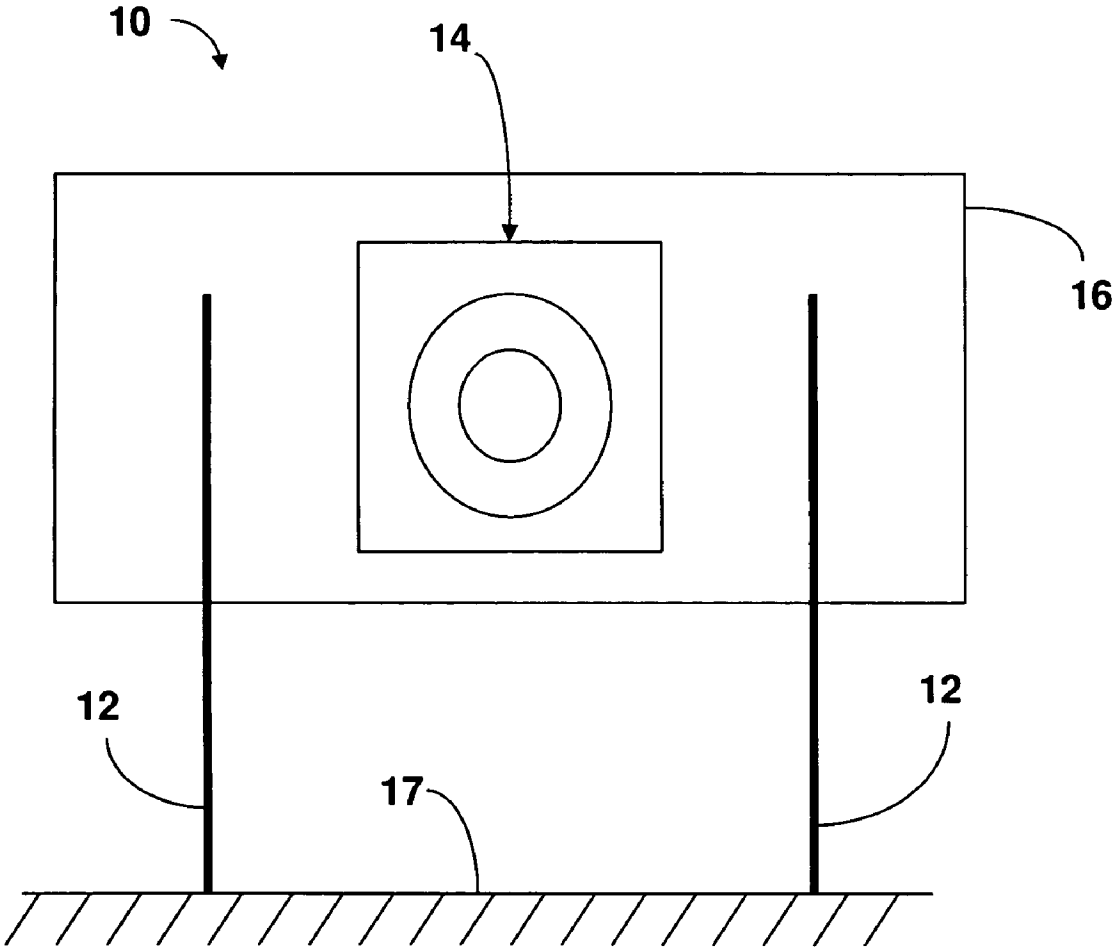
FIG. 1 is a front elevational view of a target stand system in accordance with this invention.
Figure 2:
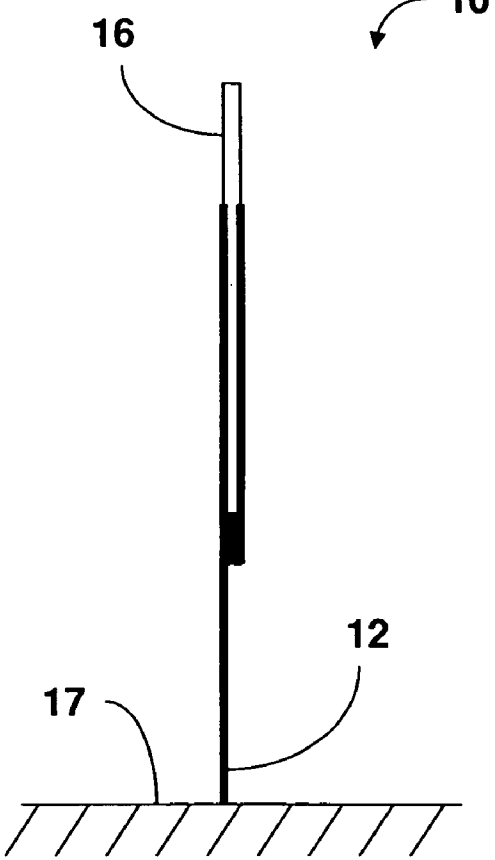
FIG. 2 is a side elevational view of the target stand system of FIG. 1 in accordance with this invention.

Referring now to FIGS. 1 and 2, there is illustrated a first embodiment of a target stand system, indicated generally at 10, adapted for use with a target in accordance with this invention. The target stand system 10 is configured to support a target at a vertical distance from a support surface. As will be explained below in detail, the target stand system 10 is adapted for use with many types, sizes and styles of targets. The target stand system 10 is also configured for use without tools and can be stored when not in use in standard size gun cases.

As shown in FIGS. 1 and 2, the target stand system 10 includes at least one stand assembly 12 for supporting at least one target 14 and a target backing 16.

In the illustrated embodiment, the target 14 is conventional in the art and is a substantially planar structure having indicia printed or formed on one major side. The target 14 is configured to provide a desired destination for the ammunition shot at the target 14. The target 14 is preferably made of material sufficient to allow the ammunition shot at the target 14 to pass through the target 14. In one embodiment, the target 14 is made of cardboard. Alternatively, the target 14 can be made of other materials, such as for example heavy paper, plastic and foam board. As indicated above, the target 14 can be any size or style.

As shown in FIGS. 1 and 2, the target 14 is mounted on a target backing 16 which is supported by the at least one stand assembly 12. Similar to the target 14, the target backing 16 is preferably made of material sufficient to allow the ammunition shot at the target 14 to pass through the target backing 16. In one embodiment, the target backing 16 is made of cardboard. Alternatively, the target backing 16 can be made of other materials, such as for example heavy paper, plastic and foam board.

As further shown in FIGS. 1 and 2, the target stand system 10 is configured for insertion into a supporting surface 17. In the illustrated embodiment, the supporting surface 17 is the ground. In another embodiment, the supporting surface 17 can be another suitable surface, such as for example bales of hay, sufficient to support the target stand system 10.

Figure 3:
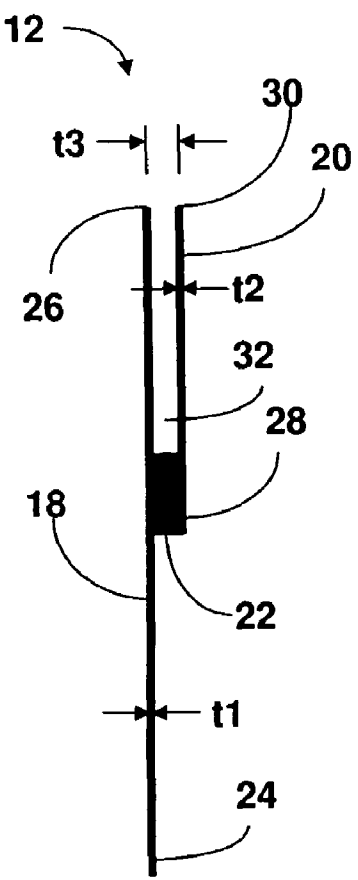
FIG. 3 is a side elevational view of a stand assembly of the target stand system of FIGS. 1 and 2.

Referring now to FIG. 3, there is illustrated a first embodiment of a stand assembly 12 in accordance with this invention. The stand assembly 12 includes a post member 18, a support member 20 and at least one attachment portion 22.

The post member 18 is configured to provide support to a first side of the target 14 or a first side of the target backing 16. In the illustrated embodiment, the post member 18 has a length in a range from about 36 inches to about 72 inches. In another embodiment, the post member 18 can have a length less than 36 inches or more than 72 inches. In the illustrated embodiment, the post member 18 is made of steel rod. Alternatively, the post member 18 can be made of another material, such as for example fiberglass or plastic, sufficient to support the first side of the target 14. In the illustrated embodiment, the post member 18 has a thickness, t1, of approximately 0.25 inches. In another embodiment, the post member 18 can have a thickness t1 more or less than 0.25 inches.

As shown in FIG. 3, the post member 18 has a first end 24 and a second end 26. The first end 24 of the post member 18 is configured for ease of insertion into the support surface 17. In the illustrated embodiment, the first end 24 of the post member 18 has a conical shape. In another embodiment, the first end 24 of the post member 18 can have another shape, such as for example a knife edge shape, sufficient to ease insertion of the post member 18 into the support surface 17. The second end 26 of the post member 18 is configured for ease of insertion of the target 14 or insertion of the target backing 16. In the illustrated embodiment, the second end of the post member 18 has a chamfered edge. In another embodiment, the second end 26 of the post member 18 can have another edge finish, such as for example a rounded edge, sufficient to ease insertion of the target 14 or insertion of the target backing 16.

As shown in FIG. 3, the support member 20 is configured to provide support to a second side of the target 14 or a second side of the target backing 16. In the illustrated embodiment, the support member 20 has a length in a range from about 16 inches to about 72 inches. In another embodiment, the support member 20 can have a length less than 16 inches or more than 72 inches. In the illustrated embodiment, the support member 20 is made of steel rod. Alternatively, the support member 20 can be made of another material, such as for example fiberglass or plastic, sufficient to support the second side of the target 14. In the illustrated embodiment, the support member 20 has a thickness t2, of approximately 0.25 inches. In another embodiment, the support member 20 can have a thickness t2 more or less than 0.25 inches.

As shown in FIG. 3, the support member 20 has a first end 28 and a second end 30. The first end 28 of the support member 20 is configured for attachment to the post member 18. The second end 30 of the support member 20 is configured for ease of insertion of the target 14 or insertion of the target backing 16. In the illustrated embodiment, the second end 30 of the support member 20 has a chamfered edge. In another embodiment, the second end 30 of the support member 20 can have another edge finish, such as for example a rounded edge, sufficient to ease insertion of the target 14 or insertion of the target backing 16.

While the embodiment shown in FIG. 3 is shown having one support member 20, it should be understood that more than one support member 20 can be used.

The attachment portion 22 of the stand assembly 12 is configured to attach the post member 18 to the support member 20 such that a gap 32 is formed therebetween. In the illustrated embodiment, the attachment portion 22 is a weldment connecting the post member 18 to the first end 28 of the support member 20. In another embodiment, the attachment portion 22 can be other fastening mechanisms, such as for example brackets, clips, clamps or studs, sufficient to fix the post member 18 to the support member 20 such that a gap 32 is formed therebetween.

While the embodiment shown in FIG. 3 is shown having one attachment portion 22, it should be understood that more than one attachment portion 22 can be used.

Referring again to FIG. 3, the gap 32 is configured to contain and support the target 14 or the target backing 16. The gap 32 has a width t3. In the illustrated embodiment, the width t3 of the gap 32 is about 0.25 inches. In another embodiment, the width t3 of the gap 32 can be more or less than 0.25 inches.

Referring again to FIGS. 1 and 2, the target stand system 10 is used by inserting the first end 24 of a stand assembly 12 into the support surface 17. Using the target 14 or the target backing 16 as a guide to determine a desired width between the stand assemblies 12, the first end 24 of a second stand assembly 12 is inserted into the support surface 17. The target 14 or the target backing 16 is inserted into the gaps 32 of the respective stand assemblies 12. The target 14 or the target backing 16 is inserted into the gaps 32 until the target 14 or target backing 16 seats against the attachment portions 22. The target stand system 10 is now ready for use. In another embodiment, the target 14 or the target backing 16 may be inserted into the gaps 32 such that the target 14 or the target backing 16 are tightly wedged in the gaps 32 prior to seating against the attachment portions 22.

At such time as the target 14 or the target backing 16 is to be replaced, the target 14 or the target backing 16 is merely removed from the target stand system 10 and a replacement target 14 or target backing 16 is inserted into gaps 32.

Figure 4:
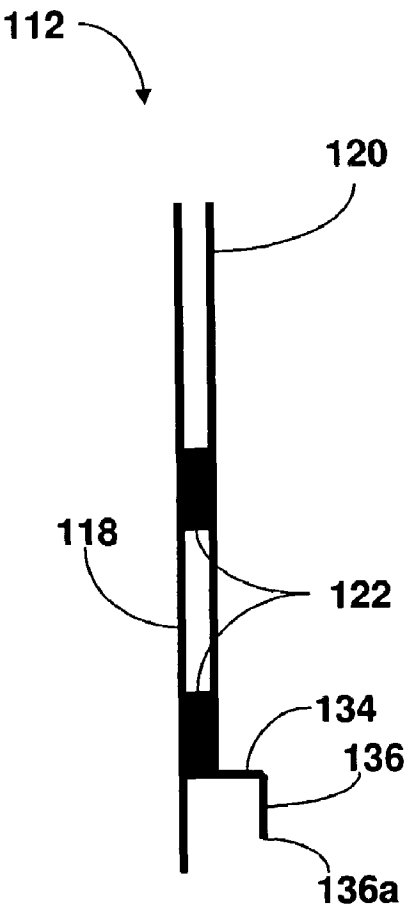
FIG. 4 is a side elevational view of a second embodiment of a stand assembly.

Referring now to FIG. 4, there is illustrated a second embodiment of the stand assembly, indicated at generally at 112. In this embodiment, the stand assembly 112 includes a post member 118, a support member 120, and at least one attachment portion 122. The post member 118 is the same as the post member shown in FIG. 3. In this embodiment, the support member 120 extends to include a step portion 134 and an insertion portion 136. The step portion 134 is configured to provide a surface for a force to be applied during the insertion of the stand assembly 112 into a support surface (not shown). In one embodiment, the force applied to the step portion 134 can be a person stepping on the step portion 134. In another embodiment, the force applied to the step portion 134 can result from another source, such as for example blows from a sledge hammer, sufficient to insert the stand assembly 112 into a support surface.

A first end **136*a* of the insertion portion 136 is configured for ease of insertion into the support surface (not shown). In the illustrated embodiment, the first end 136*a* of the insertion portion 136 has a conical shape. In another embodiment, the first end 24 of the insertion portion 136 can have another shape, such as for example a knife edge shape, sufficient to ease insertion of the insertion portion 136** into the support surface (not shown).

The at least one attachment portion 122 is the same as the attachment portion 22 shown in FIG. 3. While the embodiment shown in FIG. 4 is shown having two attachment portions 122, it should be understood that a single attachment portion 122 or more than two attachment portions 122 can be used.

Figure 5:
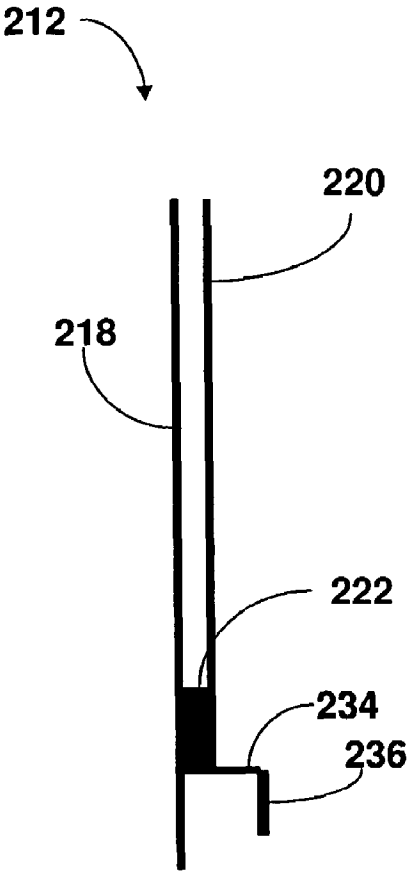
FIG. 5 is a side elevational view of a third embodiment of a stand assembly.

Referring now to FIG. 5, there is illustrated a third embodiment of the stand assembly, indicated at generally at 212. In this embodiment, the stand assembly 212 includes a post member 218, a support member 220, and at least one attachment portion 222. In this embodiment, the stand assembly 212 is configured to support the target (not shown) or the target backing (not shown) in a position relatively close to the support surface (not shown). The post member 218 and the attachment portion 222 are the same as the post member 18 and attachment portion 22 shown in FIG. 3. In this embodiment, the support member 220 includes a step portion 234 and an insertion portion 236. The step portion 234 and the insertion portion 236 are the same as the step portion 134 and insertion portion 136 shown in FIG. 4.

In this embodiment, the attachment portion 222 is positioned close to the step portion 234 and the insertion portion 236 such that the target, when inserted into the gap 232, is positioned relatively close to the support surface (not shown). While the embodiment shown in FIG. 5 is shown having a single attachment portion 222, it should be understood that more than one attachment portion 222 can be used.

Figure 6:
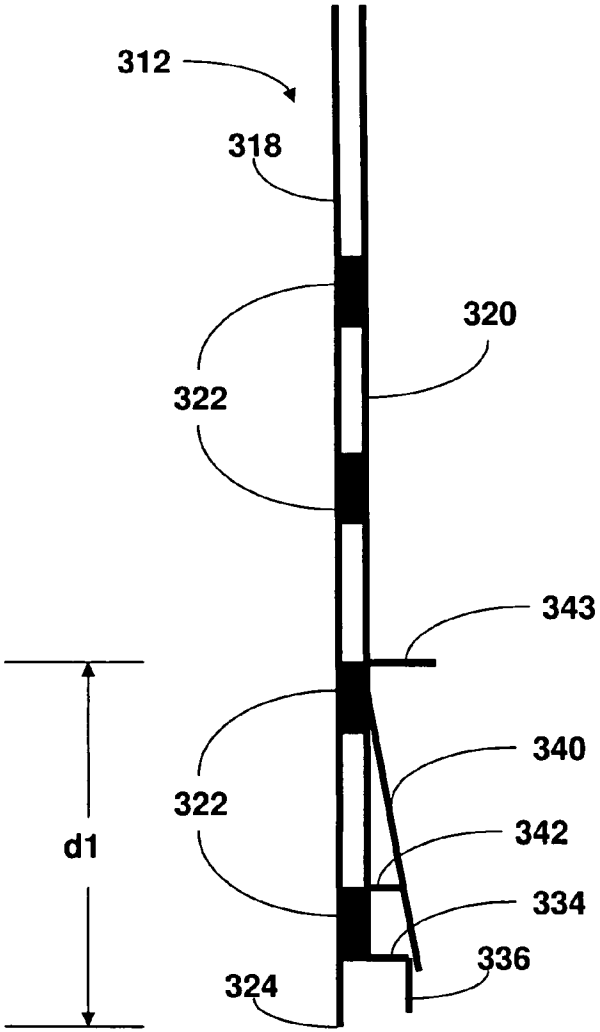
FIG. 6 is a side elevational view of a fourth embodiment of a stand assembly.

Referring now to FIG. 6, there is illustrated a fourth embodiment of the stand assembly, indicated at generally at 312. In this embodiment, the stand assembly 312 is configured to raise the target (not shown) to a relatively high level off of the support surface (not shown). In this embodiment, the stand assembly 312 includes a post member 318, a support member 320, a plurality of attachment portions 322 and a handle 343. The post member 318 and the attachment portions 322 are the same as the post member 18 and attachment portion 22 shown in FIG. 3. In this embodiment, the support member 320 includes a step portion 334 and an insertion portion 336. The step portion 334 and the insertion portion 336 are the same as the step portion 134 and insertion portion 136 shown in FIG. 4. The handle 343 is configured for use in removing the stand assembly 312 from the support surface. As shown in FIG. 6, the handle 343 is positioned a distance d1 from a first end 324 of the post member 318. In one embodiment, the distance d1 is about 28 inches. In another embodiment, the distance d1 can be more or less than 28 inches.

As further shown in FIG. 6, the support member 320 includes an angled brace 340 and at least one cross brace 342. The angled brace 340 and the at least one cross brace 342 are configured to structurally support the post member 318 and the support member 320. While the embodiment shown in FIG. 6 is shown having a single angled brace 340 and at least one cross brace 342, it should be understood that any number of angled braces 340 and any number of cross braces 342 can be used.

Figure 7:
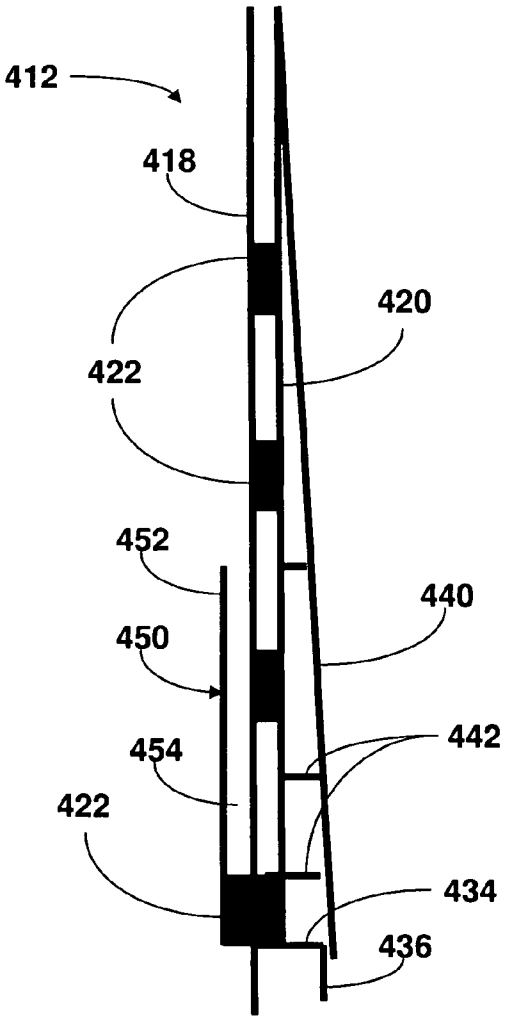
FIG. 7 is a side elevational view of a fifth embodiment of a stand assembly.

Referring now to FIG. 7, there is illustrated a fifth embodiment of the stand assembly, indicated at generally at 412. In this embodiment, the stand assembly 412 is configured to provide multiple target supporting structures. In this embodiment, the stand assembly 412 includes a post member 418, a support member 420, and a plurality of attachment portions 422. The post member 418 and the attachment portions 422 are the same as the post member 18 and attachment portion 22 shown in FIG. 3. In this embodiment, the support member 420 includes a step portion 434 and an insertion portion 436. The step portion 434 and the insertion portion 436 are the same as the step portion 134 and the insertion portion 136 shown in FIG. 4.

As further shown in FIG. 7, the support member 420 includes an angled brace 440 and a plurality of cross braces 442. The angled brace 440 and the plurality of cross braces 442 are configured to structurally support the post member 418 and the support member 420. While the embodiment shown in FIG. 7 is shown having a single angled brace 440, it should be understood that any number of angled braces 440 can be used.

As further shown in FIG. 7, the stand assembly 412 includes a target support assembly 450. The target support assembly 450 includes an assembly support member 452 and an attachment portion 422. The assembly support member 452 is connected to the post member 418 is the same manner as previously described. The assembly support member 452 forms a second gap 454 configured for a target (not shown) or target backing (not shown).

In accordance the provisions of the patent statutes, the principle and mode of operation of the target stand system have been explained and illustrated in its preferred embodiments. However, it should be understood that this invention may be practiced otherwise than as specifically explained and illustrated without departing from its spirit or scope.

What is claimed is:

1. A target stand system having at least two stand assemblies, each stand assembly comprising:

a post member configured at one end for insertion into a support surface, the post member extending a first vertical distance between a first lower end and a second upper end;

a support member extending spaced apart from and parallel to the post member, the support member extending a second vertical distance between a first lower end and a second upper end, the second vertical distance being less than the first vertical distance, the support member being connected to the post member by an attachment portion such that a vertically extending gap is formed between the post member and the support member, the gap extending from the second upper ends of the post and support members vertically downwardly toward the first lowers ends of the post and support members and having a width sufficient to support a target therewithin which is installed in the gap in a vertical manner; and a step connected to the post portion and the support member by the attachment portion, the step having a step portion and an insertion portion, the step portion extending perpendicular to the post member and the support member and providing a lower contact point with the first lower end of the support member, the insertion portion extending parallel with respect to the support member and the post member;

wherein the attachment portion is a weldment and is located directly adjacent the step portion of the step so as to directly connect the step portion to the post member and to the first lower end of the support member to provide additional strength to the step portion of the step to allow a force to be applied to the step sufficient to insert the first lower end of the post member and a lower end of the insertion portion of the step into the support surface without damage to the stand assembly;

wherein the stand assemblies are spaced apart a distance from each other to support a target.

2. The target stand system of claim 1 in which more than one attachment portion connects the support member to the post member.

3. The target stand system of claim 1 in which more than one support member is connected to the post member.

4. The target stand system of claim 1 in which the insertion end of the post member has a conical cross-sectional shape.

5. The target stand system of claim 1 in which a brace is further provided which is connected to the support member.

6. The target stand system of claim 5 in which the brace forms an angle with respect to the support member.

7. The target stand system of claim 5 in which a cross member is further provided and which connects the brace to the support member.

8. The target stand system of claim 1 in which a brace is further provided and which is connected the step to the post member.

9. The target stand system of claim 8 in which the brace forms an angle with respect to the post member.

10. The target stand system of claim 8 in which a cross member connects the brace to the post member.

11. A target stand system having at least two stand assemblies, each stand assembly comprising:

a post member configured at one end for insertion into a support surface, the post member extending a first vertical distance between a first lower end and a second upper end;

a support member extending spaced apart from and parallel to the post member, the support member extending a second vertical distance between a first lower end and a second upper end, the second vertical distance being less than the first vertical distance, the support member being connected to the post member by an attachment portion such that a first vertically extending gap is formed between the post member and the support member, the first gap extending from the second upper ends of the post and support members vertically downwardly toward the first lowers ends of the post and support members and having a width sufficient to support an upper target therewithin which is installed in the first gap in a vertical manner;

a target support assembly connected to the post member by the attachment portion such that a second gap is formed between the post member and the support assembly, wherein the second gap has a width sufficient to support a lower target therewithin which is installed in the second gap in a vertical manner; and a step connected to the post portion and the support member by the attachment portion, the step having a step portion and an insertion portion, the step portion extending perpendicular to the post member and the support member and providing a lower contact point with the first lower end of the support member, the insertion portion extending parallel with respect to the support member and the post member;

wherein the attachment portion is a weldment and is located directly adjacent the step portion of the step so as to directly connect the step portion to the post member and to the first lower end of the support member to provide additional strength to the step portion of the step to allow a force to be applied to the step sufficient to insert the first lower end of the post member and a lower end of the insertion portion of the step into the support surface without damage to the stand assembly;

wherein the stand assemblies are spaced apart a distance from each other to support the upper and lower targets.

12. The target stand system of claim 11 in which more than one attachment portion connects the support member to the post member.

13. The target stand system of claim 11 in which a brace is further provided which is connected to the support member.

14. The target stand system of claim 13 in which the brace forms an angle with respect to the support member.

* * * * *